US011125408B2

(12) United States Patent
Son et al.

(10) Patent No.: US 11,125,408 B2
(45) Date of Patent: Sep. 21, 2021

(54) LAMP FOR VEHICLE

(71) Applicant: SL Corporation, Daegu (KR)

(72) Inventors: Woo Yeong Son, Gyeongsan-si (KR); Jin Young Jung, Gyeongsan-si (KR); Hee Min Lee, Gyeongsan-si (KR); Hye Jin Han, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/071,430

(22) Filed: Oct. 15, 2020

(65) Prior Publication Data

US 2021/0199256 A1 Jul. 1, 2021

(30) Foreign Application Priority Data

Dec. 27, 2019 (KR) ..... 10-2019-0176050

(51) Int. Cl.

| | |
|---|---|
| ***F21S 41/25*** | (2018.01) |
| ***F21S 41/147*** | (2018.01) |
| ***F21S 45/48*** | (2018.01) |
| ***F21S 41/40*** | (2018.01) |

(52) U.S. Cl.

CPC ..... *F21S 41/25* (2018.01); *F21S 41/147* (2018.01); *F21S 41/40* (2018.01); *F21S 45/48* (2018.01)

(58) Field of Classification Search

None

See application file for complete search history.

(56) References Cited

U.S. PATENT DOCUMENTS

| | | | | |
|---|---|---|---|---|
| 2012/0039083 | A1* | 2/2012 | Meyrenaud | F21S 41/43 362/516 |
| 2014/0321143 | A1* | 10/2014 | Hossfeld | F21S 41/321 362/516 |
| 2018/0058652 | A1* | 3/2018 | Taudt | F21S 41/255 |
| 2018/0187851 | A1* | 7/2018 | Hossfeld | F21S 41/40 |
| 2019/0242543 | A1* | 8/2019 | Guan | F21S 41/255 |

* cited by examiner

*Primary Examiner* — Elmito Breval

(74) *Attorney, Agent, or Firm* — Nelson Mullins Riley & Scarborough LLP; Kongsik Kim, Esq.

(57) ABSTRACT

A lamp for a vehicle includes a light source unit for emitting light; a lens unit for irradiating the light emitted from the light source unit to exterior; and a shield disposed between the light source unit and the lens unit. The light source unit comprises a first light source module including at least one first light source, and at least one first optical member arranged corresponding to the first light source to emit light from the first light source to the lens unit; and a second light source module disposed above the first light source module, the second light source module including at least one second light source, and at least one second optical member arranged corresponding to the second light source to emit light from the second light source to the lens unit.

16 Claims, 11 Drawing Sheets

LAMP FOR VEHICLE

CROSS-REFERENCE TO RELATED APPLICATION

This application claims priority from Korean Patent Application No. 10-2019-0176050 filed on Dec. 27, 2019, which application is incorporated herein by reference in its entirety.

BACKGROUND

1. Technical Field

The present disclosure relates to a lamp for a vehicle, and more particularly to a compact lamp for a vehicle that implements downward light distribution (e.g., low beam) and upward light distribution (e.g., high beam).

2. Description of the Related Art

Generally, a vehicle is equipped with various types of vehicle lamps having an illumination function for confirming an object in the vicinity of the vehicle at low light conditions (e.g., nighttime driving), and a signal function for notifying other vehicle or road users of the operating state of the vehicle.

For example, the vehicle is mainly equipped with a head lamp and a fog lamp for the purpose of the illumination function, and a turn signal lamp, a tail lamp, a brake lamp, side markers, or the like for the signal functions. These vehicle lamps are stipulated by laws and regulations for their installation standards and specifications to ensure that each function can be fully utilized.

Among the lamps for the vehicle, the head lamp forms a low beam pattern or a high beam pattern to secure a driver's forward view when driving the vehicle in a low light environment such as at nighttime, which is important for safe driving. The head lamp usually maintains a low beam pattern in order to prevent glare to the driver of the oncoming vehicle or the preceding vehicle, and forms a high beam pattern as needed when driving at high speeds or when driving in dark surroundings, thereby promoting safe driving.

The head lamp requires various components such as a light source, a reflector, or a shield to form an appropriate beam pattern based on the driving environment of the vehicle. As such, there is a limit in reducing the size of the head lamp.

Accordingly, there is a demand for reducing the size of the head lamp and forming an appropriate beam pattern.

SUMMARY

Aspects of the present disclosure provide a lamp for a vehicle that is capable of implementing a sub-beam along with a high beam, and capable of being made compact and slim. Aspects of the present disclosure also provide a lamp for a vehicle with easy assembly and improved optical efficiency. However, aspects of the present disclosure are not restricted to those set forth herein. The above and other aspects of the present disclosure will become more apparent to one of ordinary skill in the art to which the present disclosure pertains by referencing the detailed description of the present disclosure given below.

According to an aspect of the present disclosure, a lamp for a vehicle may include a light source unit for emitting light; a lens unit for irradiating the light emitted from the light source unit to exterior of the lamp; and a shield disposed between the light source unit and the lens unit. The light source unit may comprise a first light source module including at least one first light source, and at least one first optical member arranged corresponding to the first light source to emit light from the first light source to the lens unit; and a second light source module disposed above the first light source module, the second light source module including at least one second light source, and at least one second optical member arranged corresponding to the second light source to emit light from the second light source to the lens unit.

A substrate may be further provided on a rear surface of the light source unit for mounting the first light source and the second light source thereon. The substrate may be inclined such that a lower side thereof is closer to the lens unit than an upper side thereof.

The second optical member may be disposed above the first optical member, and the first optical member and the second optical member may be integrally formed. A plurality of first light sources may be provided to correspond to one first optical member, and one second light source may be provided to correspond to one second optical member.

A first emitting surface from which the light of the first light source is emitted may be formed on a front surface of the first optical member, and a plurality of first incident surfaces on which the light of the first light source is incident may be formed on a rear surface of the first optical member. The plurality of first incident surfaces may correspond to the first emitting surface, the first emitting surface may be formed overall convex, with a planar middle portion, and at least one first light source may be arranged for each of the plurality of first incident surfaces. The first emitting surface may include an inclined surface that is inclined in a direction toward the first incident surface on both sides of the planar middle portion.

A second emitting surface from which the light of the second light source is emitted may be formed on a front surface of the second optical member, and a second incident surface on which the light of the second light source is incident may be formed on a rear surface of the second optical member. One second incident surface may correspond to the second emitting surface, the second emitting surface may be formed concavely, and one second light source may be arranged for the second incident surface. A plurality of second optical members may be correspondingly arranged above the first optical member.

A thickness of the shield may decrease going from a light source unit side toward a lens unit side. In particular, a lower surface of the shield may be parallel with an optical axis of the light source unit, and an upper surface of the shield may be inclined toward the lower surface going from the light source unit side to the lens unit side.

A focal point of the first light source module may be arranged behind in a light traveling direction than a focal point of the second light source module. In particular, the focal point of the first light source module may be formed at or near an end of the shield, and the focal point of the second light source module may be formed at a predetermined distance from the end of the shield toward the lens unit.

The lens unit may comprise a first lens arranged in front of the shield, and the light emitted from the first optical member and the light emitted from the second optical member may be incident on the first lens. The lens unit may also comprise a second lens arranged in front of the first lens in a light traveling direction, and the light emitted from the first lens may be incident on the second lens and may be emitted forward. In particular, the light emitted from the first optical member and the light emitted from the second optical member may transmit through the first lens and the second lens to form a predetermined light distribution pattern, respectively.

The first lens and the second lens may be formed of different materials. In particular, the first lens may include a material with heat-resistance, and the second lens may include a material for decreasing chromatic aberration.

Incident surfaces of the first lens and the second lens may be respectively formed as convex surfaces. On the other hand, an emitting surface of the first lens may be formed as an aspherical surface, and an emitting surface of the second lens may be formed as a curved surface or a flat surface.

The lamp for the vehicle may further include a heat dissipation unit disposed on a rear surface of the light source unit; and a support member to which the heat dissipation unit, the light source unit, the shield, and the lens unit are fixedly supported.

The lamp for the vehicle according to an exemplary embodiment of the present disclosure as described above may improve optical efficiency by implementing the sub-low beam along with the high beam. In addition, various types of beams may be implemented depending on a situation or environment. In addition, in the lamp for the vehicle according to an exemplary embodiment of the present disclosure as described above, light sources corresponding to the high beam and the sub-low beam may be formed on one substrate, and collimator lenses corresponding to the high beam and the sub-low beam may be integrally formed. Therefore, the assembly may become more convenient and simplified, and the lamp for the vehicle may be miniaturized and made slim. The benefits of the present disclosure are not limited to the above-mentioned benefits, and other benefits not mentioned may be clearly understood by a person skilled in the art from the claims.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
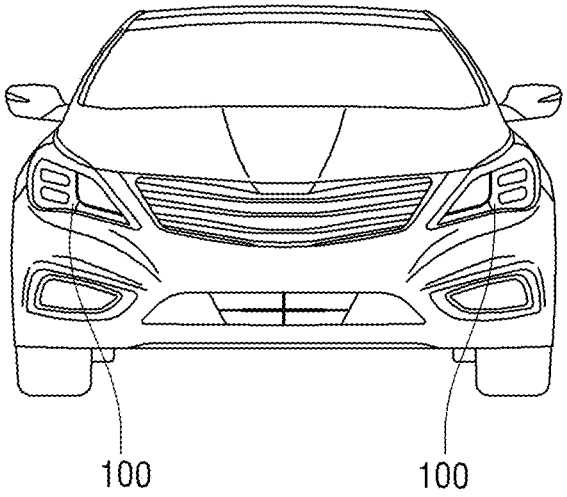
FIG. 1 shows a lamp for a vehicle according to an exemplary embodiment of the present disclosure as applied to a vehicle.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the disclosure to those skilled in the art, and the present disclosure will only be defined by the appended claims. Throughout the specification, like reference numerals in the drawings denote like elements.

In some exemplary embodiments, well-known steps, structures and techniques will not be described in detail to avoid obscuring the disclosure.

The terminology used herein is for the purpose of describing particular exemplary embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Exemplary embodiments of the disclosure are described herein with reference to plan and cross-section illustrations that are schematic illustrations of idealized exemplary embodiments of the disclosure. As such, variations from the shapes of the illustrations as a result, for example, of manufacturing techniques and/or tolerances, are to be expected. Thus, exemplary embodiments of the disclosure should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for explaining a lamp for a vehicle 100 according to exemplary embodiments of the present disclosure.

Figure 2:
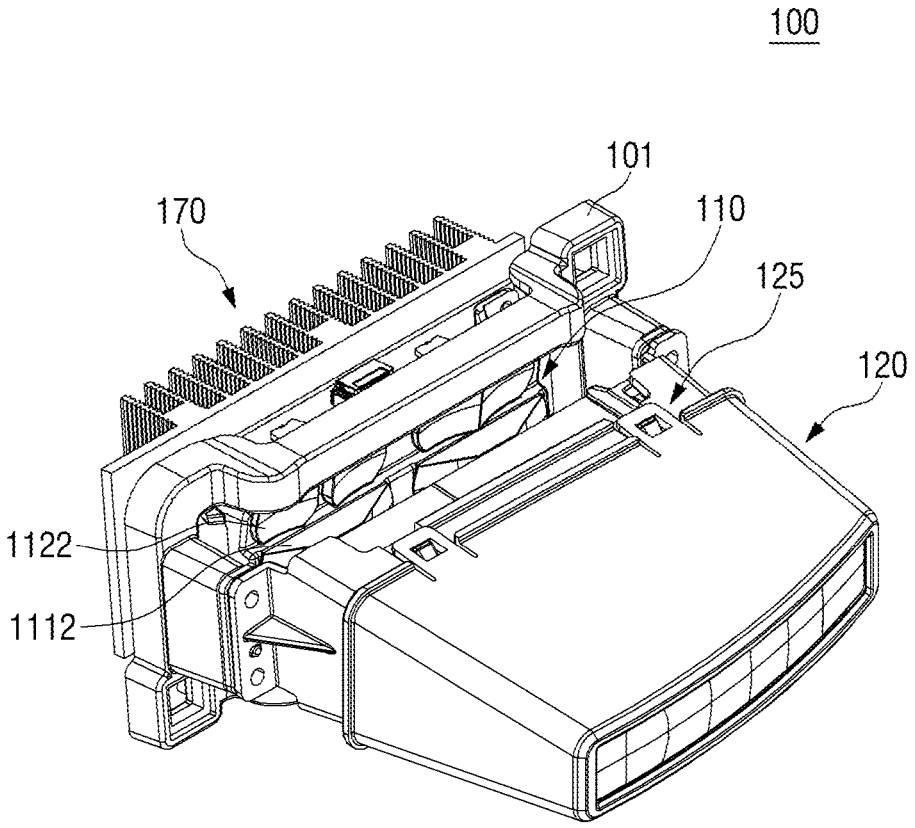
FIG. 2 is a schematic perspective view of the lamp for the vehicle according to the exemplary embodiment of the present disclosure.
Figure 3:
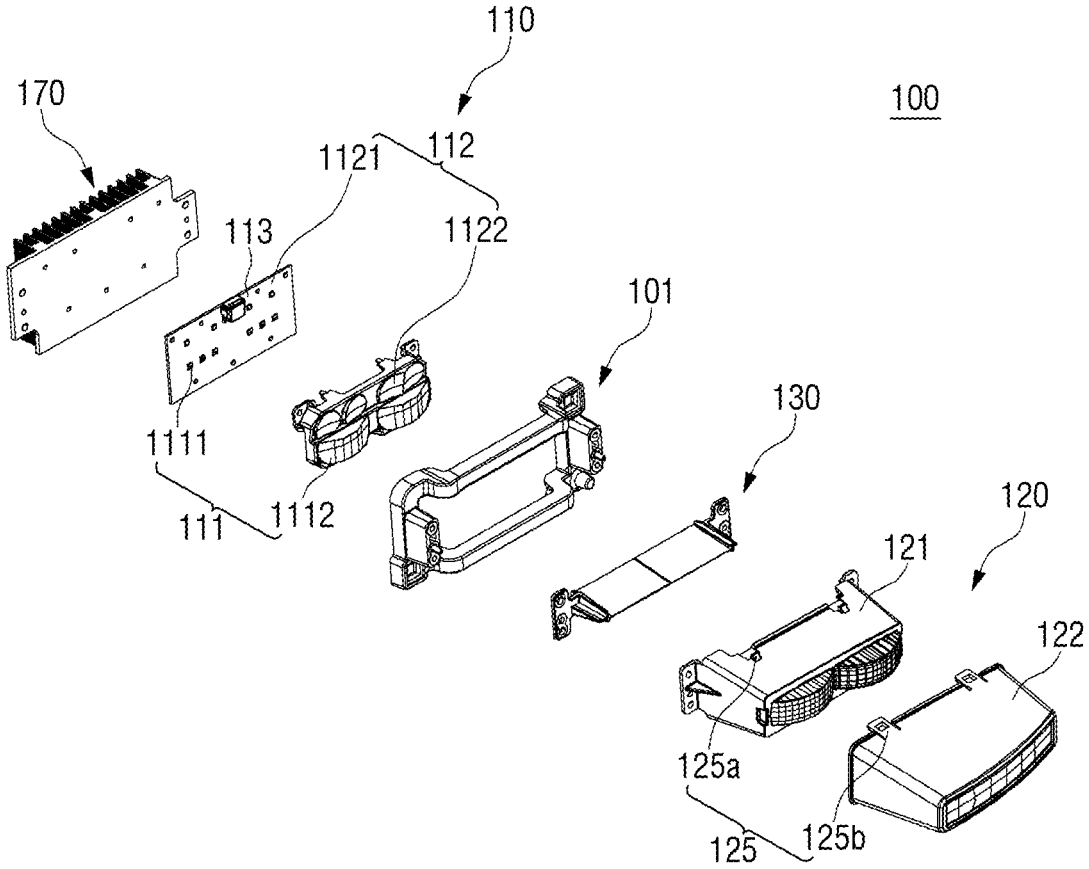
FIG. 3 is a schematic exploded perspective view of the lamp for the vehicle according to the exemplary embodiment of the present disclosure.
Figure 4:
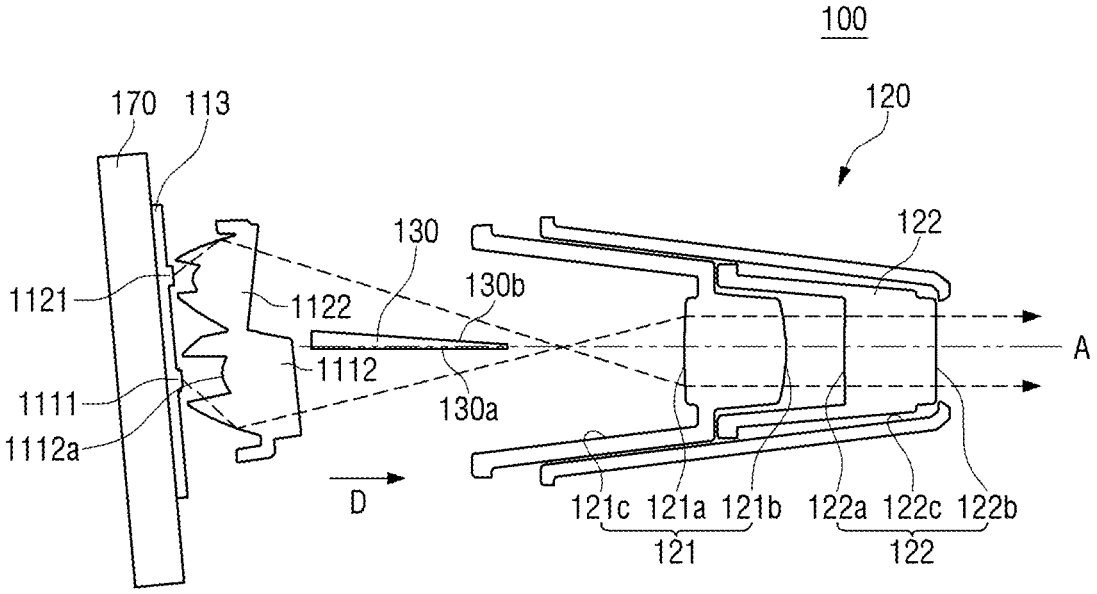
FIG. 4 is a schematic cross-sectional view of the lamp for the vehicle according to the exemplary embodiment of the present disclosure.

FIG. 1 shows the lamp for the vehicle 100 according to an exemplary embodiment of the present disclosure as applied to a vehicle. FIG. 2 is a schematic perspective view of the lamp for the vehicle 100 according to the exemplary embodiment of the present disclosure. FIG. 3 is a schematic exploded perspective view of the lamp for the vehicle 100 according to the exemplary embodiment of the present disclosure. FIG. 4 is a schematic cross-sectional view of the lamp for the vehicle 100 according to the exemplary embodiment of the present disclosure.

Referring to FIGS. 1 to 4, the lamp for the vehicle 100 according to the exemplary embodiment of the present disclosure may include a light source unit 110, a shield 130, and a lens unit 120. The light source unit 110 may receive electrical power and emit light to the lens unit 120 which will be described below.

The light source unit 110 according to the exemplary embodiment of the present disclosure may include light sources 1111 and 1121 provided on a substrate 113, and optical members 1112 and 1122. In addition, the light source unit 110 may have a structure configured to implement a sub-low beam while implementing a high beam as a main beam. The optical members 1112 and 1122 according to the exemplary embodiment of the present disclosure may include a collimator lens. However, as described above, the optical members 1112 and 1122 according to the exemplary embodiment of the present disclosure are not limited to the collimated lens. For example, the optical member 1112 and 1122 may be provided with a lens for guiding light emitted from a light source to form parallel light, for example, a total internal reflection (TIR) lens or a Fresnel lens. In other words, various changes or modifications will be possible. The specific configuration of the light source unit 110 may be described below. The lens unit 120 may allow light to be irradiated from the light source unit 110 to the exterior of the lamp for the vehicle 100.

The shield 130 may be disposed between the light source unit 110 and the lens unit 120, and the shield 130 may block or obstruct a part of the light irradiated from the light source unit 110 to form a predetermined cut-off line.

In addition, the substrate 113 according to the exemplary embodiment of the present disclosure may be arranged on a rear surface of the light source unit 110. The substrate 113 may be formed to be inclined with respect to a direction perpendicular to an optical axis direction such that the lower side thereof is closer to the lens unit 120 than the upper side thereof. The light sources (e.g., a first light source 1111 and a second light source 1121 which will be described below) of the light source unit 110 may be mounted together on one substrate 113.

The light source unit 110 according to the exemplary embodiment of the present disclosure may include the light sources 1111 and 1121 disposed on the substrate 113, and the optical members 1112 and 1122, and may have a structure configured to implement a sub-low beam while implementing a high beam as a main beam.

Specifically, the light source unit 110 may include a first light source module 111 and a second light source module 112. The first light source module 111 may be disposed on a lower side of the substrate 113 and may be configured to implement a high beam. The second light source module 112 may be disposed on an upper side of the substrate 113 and may be configured to implement a sub-low beam.

The first light source module 111 may include at least one first light source 1111, and at least one first optical member 1112 that is arranged to correspond to the first light source 1111 to emit light from the first light source 1111 to the lens unit 120. In addition, the second light source module 112 may be provided above the first light source module 111. Herein, the term "above" may be understood in regard to the orientation shown in FIG. 4. However, depending on the actual mounting orientation of the lamp for the vehicle 100, the absolute direction of the second light source module 112 with respect to the first light source module 111 may vary.

The second light source module 112 may include at least one second light source 1121, and at least one second optical member 1122 that is arranged corresponding to the second light source 1121 to emit light from the second light source 1121 to the lens unit 120. In addition, as described above, the first light source 1111 and the second light source 1121 may together be disposed on the inclined substrate 113.

The first light source 1111 may be disposed on a lower side relative to the second light source 1121 in a lower region of the substrate 113, such that it may be arranged on the substrate 113 along a substantially horizontal direction that is orthogonal to an optical axis A. In addition, the second light source 1121 may be disposed on an upper side relative to the first light source 1111 in an upper region of the substrate 113, such that it may be arranged on the substrate 113 along the substantially horizontal direction that is orthogonal to the optical axis A.

In the exemplary embodiment of the disclosure, a plurality of the first light sources 1111, for example, three, may be provided to correspond to one first optical member 1112, and one second light source 1121 may be provided to correspond to one second optical member 1122.

In addition, the first light source 1111 and the second light source 1121 may be provided in the form of one or more chips. For example, according to the present disclosure, one first light source 1111 may include two chips (e.g., LED chips), and one second light source 1121 may include one chip. Since three first light sources 1111 may be mounted on one of the first optical members 1112, which will be described below, the first light source module 111 may be provided in a 2-2-2 chip arrangement. In addition, one second light source 1121 may be mounted on one of the second optical members 1122, which will be described below, and may be provided in a single chip arrangement.

In the exemplary embodiment of the present disclosure, the first light source module 111 may be configured to implement a high beam, and the second light source module 112 may be configured to implement a sub-low beam while supplementing the first light source module 111 that implement the high beam. In some embodiments, the number of the first light sources 1111 mounted may be greater than the number of the second light sources 1121.

The first optical member 1112 and the second optical member 1122 may be formed integrally. In addition, the second optical member 1122 may be positioned on an upper side of the first optical member 1112, the first optical member 1112 may be positioned in front of the first light source 1111, and the second optical member 1122 may be positioned in front of the second light source 1121 on a top of the first optical member 1112.

In addition, the first optical member 1112 may be a lens for implementing a high beam, and two lenses may be arranged in the horizontal direction. The second optical member 1122 may be a lens for implementing a sub-low beam, and four lenses may be arranged in the horizontal direction. Accordingly, according to the present disclosure, two second optical members 1122 may be arranged on the top of the first optical member 1112 as shown in FIG. 3. In addition, six of the first light sources 1111, each including two chips, may be arranged in the horizontal direction, and may be provided in a 2-2-2-2-2-2 chip arrangement. Four of the second light sources 1121, each including one chip, may be arranged in the horizontal direction, and may be provided in a 1-1-1-1 chip arrangement.

In addition, a heat dissipation unit 170 for dissipating heat generated by the substrate 113 or the first light source 1111 and the second light source 1121 may be further provided on a rear surface of the light source unit 110, specifically on a rear surface of the substrate 113.

In addition, a support member 101 by which the heat dissipation unit 170, the light source unit 110, the shield 130, and the lens unit 120 are fixedly supported may be further provided. In other words, the support member 101 may allow the heat dissipation unit 170, the substrate 113, and the light source unit 110 to be stacked while being coupled in the state in which the shield 130 is seated inside the lens unit 120.

Figure 5:
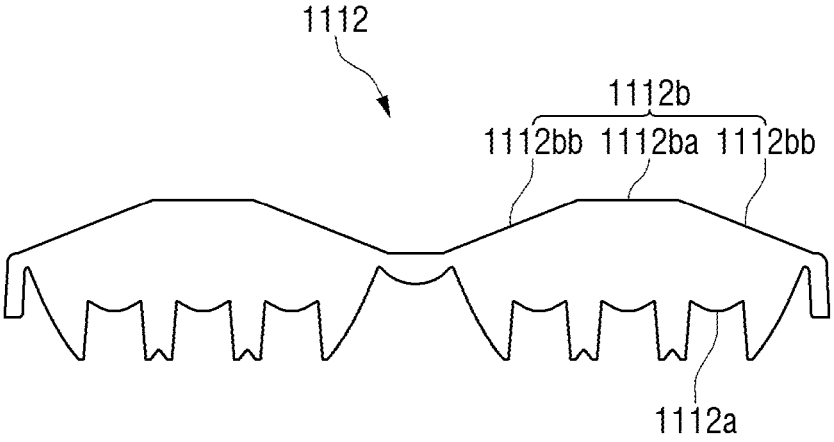
FIG. 5 is a plan view of a first optical member in the lamp for the vehicle according to the exemplary embodiment of the present disclosure.
Figure 6:
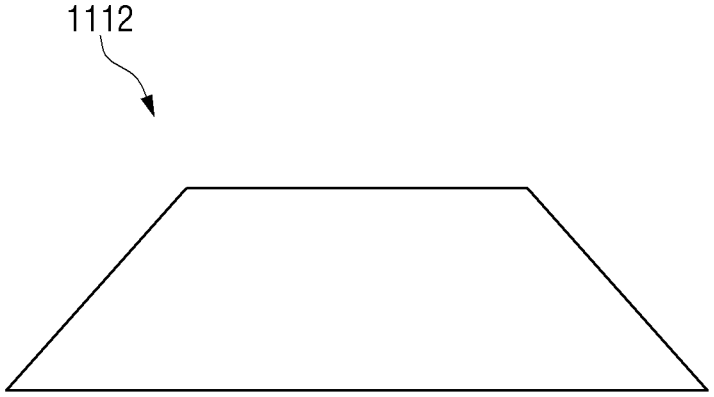
FIG. 6 is a schematic plan view of the first optical member in the lamp for the vehicle according to the exemplary embodiment of the present disclosure.
Figure 7:
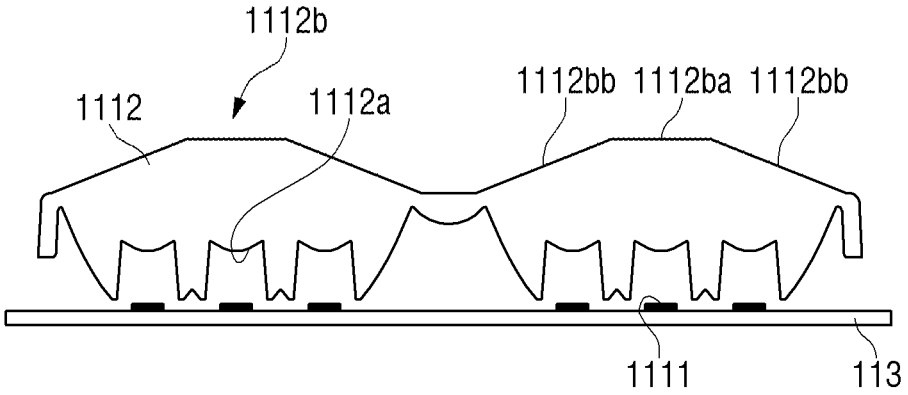
FIG. 7 is a plan view of a first light source module in the lamp for the vehicle according to the exemplary embodiment of the present disclosure.

FIG. 5 is a plan view of the first optical member 1112 in the lamp for the vehicle 100 according to the exemplary embodiment of the present disclosure. FIG. 6 is a schematic plan view of the first optical member 1112 in the lamp for the vehicle 100 according to the exemplary embodiment of the present disclosure. FIG. 7 is a plan view of the first light source module 111 in the lamp for the vehicle 100 according to the exemplary embodiment of the present disclosure.

Referring to FIGS. 5 to 7, the first optical member 1112 according to the exemplary embodiment of the present disclosure may be disposed in front of the substrate 113 having the first light source 1111. The first optical member 1112 may include a first incident surface 1112*a* and a first emitting surface 1112*b*. The first incident surface 1112*a* may be provided on a rear surface of the first optical member 1112, and may allow the light from the first light source 1111 to be incident thereon.

A plurality of first incident surfaces 1112*a*, for example three, may be formed on one of the first optical members 1112. One first light source 1111 may be arranged for each of the plurality of first incident surfaces 1112*a* (i.e., two chips may be arranged for each of the plurality of first incident surfaces 1112*a*). In some embodiments, two or more first light sources 1111 may be arranged for each of the plurality of first incident surfaces 1112*a*. Each of the two or more first light sources 1111 may include one or more chips. Further, in the exemplary embodiment of the present disclosure, two of the first optical members 1112 may be provided adjacent to each other in the horizontal direction. In addition, three first incident surfaces 1112*a* may be formed on each of the first optical members 1112, and the first light source 1111 may be arranged on one of the first incident surfaces 1112*a*. Since three first incident surfaces 1112*a* may be arranged on one first optical member 1112, and two first optical members 1112 may be horizontally arranged, six first light sources 1111 may be provided in a lower region of the substrate 113, and chips may be provided in a 2-2-2-2-2-2 arrangement.

The first emitting surface 1112*b* may be provided on a front surface of the first optical member 1112, and may emit the light from the first light source 1111. The first emitting surface 1112*b* according to the exemplary embodiment of the present disclosure may be convexly formed overall, and a middle portion of the first emitting surface 1112*b* may be formed as a plane (i.e., a planar middle portion 1112*ba*). Specifically, the first emitting surface 1112*b* may form an inclined surface 1112*bb* that is inclined toward the first incident surface 1112*a* on both sides of the planar middle portion 1112*ba*. In other words, the first emitting surface 1112*b* may be formed in overall convex shape including the inclined surface 1112*bb*-the planar middle portion 1112*ba*-another inclined surface 1112*bb*. Accordingly, when the first optical member 1112 is viewed from the top, a trapezoidal shape may be formed as shown in FIG. 6. Due to the first collimator lens 1112 formed in the trapezoid shape, the light may be collimated to the center.

Figure 8:
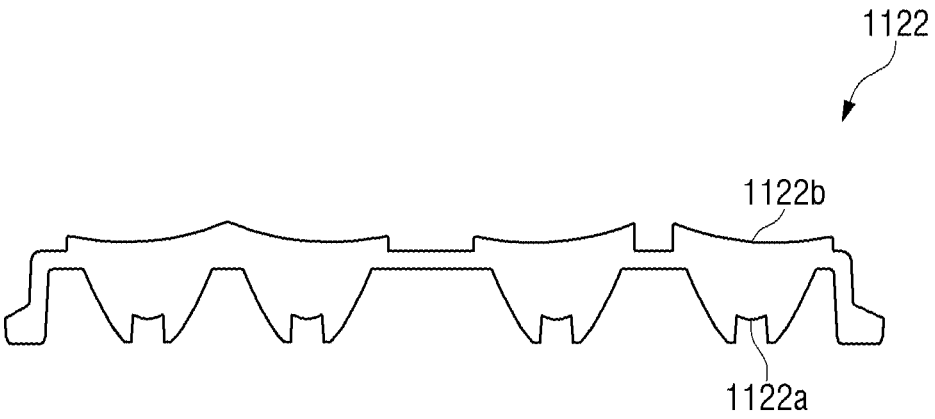
FIG. 8 is a plan view of a second optical member in the lamp for the vehicle according to the exemplary embodiment of the present disclosure.
Figure 9:
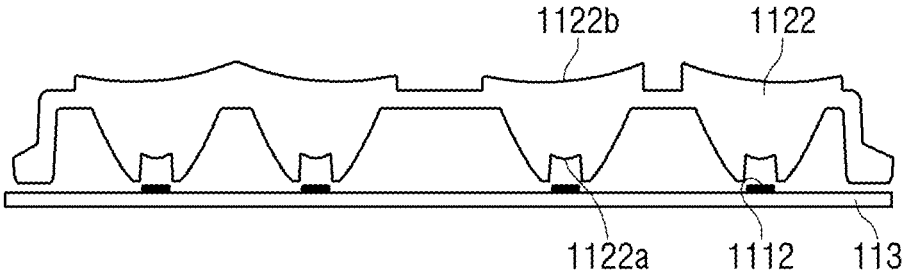
FIG. 9 is a plan view of a second light source module in the lamp for the vehicle according to the exemplary embodiment of the present disclosure.

FIG. 8 is a plan view of the second optical member 1122 in the lamp for the vehicle 100 according to the exemplary embodiment of the present disclosure. FIG. 9 is a plan view of the second light source module 112 in the lamp for the vehicle 100 according to the exemplary embodiment of the present disclosure.

Referring to FIGS. 8 and 9, the second optical member 1122 according to the exemplary embodiment of the present disclosure may be disposed in front of the substrate 113 having the second light source 1121, and may be provided integrally with the first optical member 1112 vertically above the first optical member 1112. The second optical member 1122 may include a second incident surface 1122*a* and a second emitting surface 1122*b*. The second incident surface 1122*a* may be provided on a rear surface of the second optical member 1122, and may allow the light from the second light source 1121 to be incident thereon. One second incident surface 1122*a* may be formed on the rear surface of the second optical member 1122, and one second light source 1121 may be arranged for the second incident surface 1122*a*.

Accordingly, one second incident surface 1122*a* may be arranged on one second optical member 1122, and four second optical members 1122 may be horizontally arranged. Therefore, four second light sources 1121 may be provided in an upper region of the substrate 113, and chips may be provided in a 1-1-1-1 arrangement.

The second emitting surface 1122*b* may be provided on a front surface of the second optical member 1122, and may emit the light from the second light source 1121. The second emitting surface 1122*b* according to the exemplary embodiment of the present disclosure may be formed concavely. Accordingly, the light incident from the second light source 1121 may be emitted to be spread or diverged.

Figure 10:
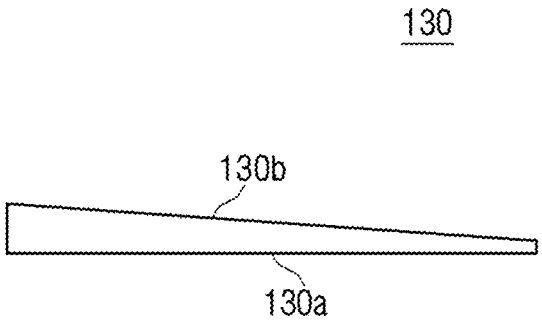
FIG. 10 is a cross-sectional view of a shield in the lamp for the vehicle according to the exemplary embodiment of the present disclosure.

FIG. 10 is a cross-sectional view of the shield 130 of the lamp for the vehicle 100 according to the exemplary embodiment of the present disclosure. Referring to FIG. 4, the shield 130 according to the present disclosure may be disposed between the first/second optical members 1112, 1122 and the lens unit 120. To avoid or minimize a perception of light discontinuation (e.g., at the interface between the low beam pattern and the high beam pattern), the shield 130 may be formed to become thinner going from the light source unit 110 side toward the lens unit 120 side. In addition, a lower surface of the shield 130 may be provided horizontally and parallel with respect to the optical axis A, and an upper surface of the shield 130 may be inclined toward the lower surface of the shield 130 going from the light source unit 110 side to the lens unit 120 side. According to the present disclosure, due to the thickness of the shield 130 decreasing from the light source unit 110 side toward the lens unit 120 side, the perception of discontinuation may be minimized.

As the lower surface of the shield 130 is horizontal and the upper surface 130*b* of the shield 130 is inclined toward the lower surface 130*a* of the shield 130, a focal point of the first light source module 111 may be formed at or near an end of the shield 130, and a focal point of the second light source module 112 may be formed at a predetermined distance from the end of the shield 130 toward the lens unit 120. In other words, the focal point of the first light source module 111 may be arranged behind in terms of a light traveling direction D shown in FIG. 4 than the focal point of the second light source module 112.

Figure 11:
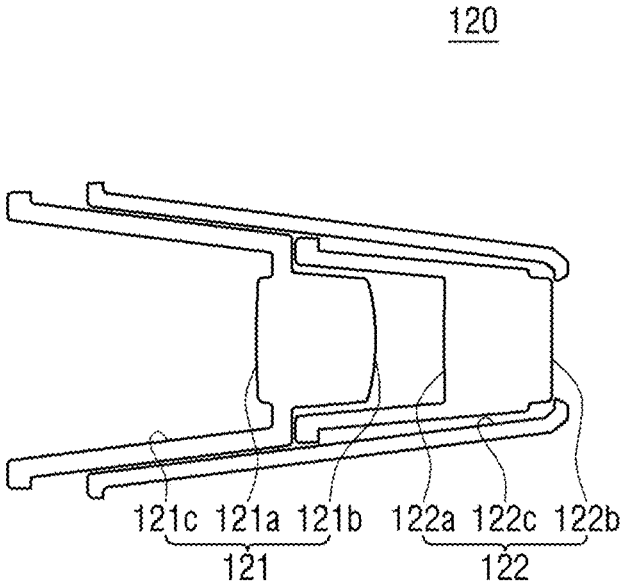
FIG. 11 is a cross-sectional view of a lens unit in the lamp for the vehicle according to the exemplary embodiment of the present disclosure.

FIG. 11 is a cross-sectional view of the lens unit 120 of the lamp for the vehicle 100 according to the exemplary embodiment of the present disclosure. Referring to FIG. 4, the lens unit 120 according to the exemplary embodiment of the present disclosure may be disposed in front of the shield 130, and may irradiate the light emitted from the light source unit 110 to the exterior. In particular, the lens unit 120 may transmit the light emitted from the first optical member 1112 and the light emitted from the second optical member 1122 to form a predetermined light distribution pattern, respectively.

The lens unit 120 according to the exemplary embodiment of the present disclosure may include a first lens 121 and a second lens 122. The first lens 121 may be disposed in front of the shield 130, and may emit the light from the first optical member 1112 and the second optical member 1122. The first lens 121 according to the exemplary embodiment of the present disclosure may include, for example, a polycarbonate material for heat-resistance. However, the material of the first lens 121 is not limited thereto, and any material with heat-resistance may be adopted. An incident surface 121*a* of the first lens 121 may be formed as a convex surface, and an emitting surface 121*b* of the first lens 121 may be formed as an aspherical surface. At a rear side of the second lens 122, a groove into which the first lens 121 is inserted may be formed, to allow the first lens 121 to be seated in the groove of the second lens 122, and to allow the light output from the first lens 121 to be emitted to the exterior.

The second lens 122 may include a material for decreasing chromatic aberration, for example, a poly-methyl methacrylate (PMMA) material. However, the material of the second lens 122 is not limited thereto, and any material for decreasing chromatic aberration may be adopted. The incident surface 122*a* of the second lens 122 may be formed as a convex surface, and the emitting surface 122*b* of the second lens 122 may be formed as either a curved surface or a flat surface.

The light emitted from the first optical member 1112 and the light emitted from the second optical member 1122 may transmit through the incident surface 121*a* and the emitting surface 121*b* of the first lens 121 and subsequently through the incident surface 122*a* and the emitting surface 122*b* of the second lens 122, respectively, to form a desired light distribution pattern.

In the exemplary embodiment of the present disclosure, the first lens 121 may be formed on a front surface of a first lens housing 121*c*, and the second lens 122 may be formed on a front surface of a second lens housing 122*c*. In addition, the first lens housing 121*c* may be seated on the second lens housing 122*c*. The first lens housing 121*c* and the second lens housing 122*c* may be coupled to each other via a snap-fit coupling portion 125 (125*a* and 125*b*) shown in FIG. 3.

In concluding the detailed description, those skilled in the art will appreciate that many variations and modifications can be made to the exemplary embodiments without substantially departing from the principles of the present disclosure. Therefore, the disclosed exemplary embodiments of the disclosure are used in a generic and descriptive sense only and not for purposes of limitation.

What is claimed is:

1. A lamp for a vehicle, comprising:

a light source unit for emitting light;

a lens unit for irradiating the light emitted from the light source unit to exterior of the lamp; and a shield disposed between the light source unit and the lens unit, wherein the light source unit comprises:

a first light source module including at least one first light source, and at least one first optical member arranged corresponding to the first light source to emit light from the first light source to the lens unit; and a second light source module disposed above the first light source module, the second light source module including at least one second light source, and at least one second optical member arranged corresponding to the second light source to emit light from the second light source to the lens unit wherein the lens unit comprises:

a first lens arranged in front of the shield, wherein the light emitted from the first optical member and the light emitted from the second optical member are incident on the first lens; and a second lens arranged in front of the first lens in a light traveling direction, wherein the light emitted from the first lens is incident on the second lens and is emitted forward, and wherein the light emitted from the first optical member and the light emitted from the second optical member transmit through the first lens and the second lens to form a predetermined light distribution pattern, respectively.

2. The lamp of claim 1, further comprising:

a substrate disposed on a rear surface of the light source unit for mounting the first light source and the second light source thereon.

3. The lamp of claim 2, wherein the substrate is inclined such that a lower side thereof is closer to the lens unit than an upper side thereof.

4. The lamp of claim 1, wherein the second optical member is disposed above the first optical member, and wherein the first optical member and the second optical member are integrally formed.

5. The lamp of claim 4, wherein a plurality of second optical members are correspondingly arranged above the first optical member.

6. The lamp of claim 1, wherein a plurality of first light sources are provided to correspond to one first optical member, and one second light source is provided to correspond to one second optical member.

7. The lamp of claim 1, wherein a first emitting surface from which the light of the first light source is emitted is formed on a front surface of the first optical member, wherein a plurality of first incident surfaces on which the light of the first light source is incident are formed on a rear surface of the first optical member, wherein the plurality of first incident surfaces correspond to the first emitting surface, wherein the first emitting surface is formed overall convex, with a planar middle portion, and wherein at least one first light source is arranged for each of the plurality of first incident surfaces.

8. The lamp of claim 7, wherein the first emitting surface includes an inclined surface that is inclined in a direction toward the first incident surface on both sides of the planar middle portion.

9. The lamp of claim 1, wherein a second emitting surface from which the light of the second light source is emitted is formed on a front surface of the second optical member, wherein a second incident surface on which the light of the second light source is incident is formed on a rear surface of the second optical member, wherein one second incident surface correspond to the second emitting surface, wherein the second emitting surface is formed concavely, and wherein one second light source is arranged for the second incident surface.

10. The lamp of claim 1, wherein a thickness of the shield decreases going from a light source unit side toward a lens unit side.

11. The lamp of claim 1, wherein a lower surface of the shield is parallel with an optical axis of the light source unit, and an upper surface of the shield is inclined toward the lower surface of the shield going from a light source unit side to a lens unit side.

12. The lamp of claim 1, wherein a focal point of the first light source module is arranged behind in a light traveling direction than a focal point of the second light source module, and wherein the focal point of the first light source module is formed at or near an end of the shield, and wherein the focal point of the second light source module is formed at a predetermined distance from the end of the shield toward the lens unit.

13. The lamp of claim 1, wherein the first lens and the second lens are formed of different materials, and wherein the first lens includes a material with heat-resistance, and the second lens includes a material for decreasing chromatic aberration.

14. The lamp of claim 1, wherein incident surfaces of the first lens and the second lens are respectively formed as convex surfaces, and wherein an emitting surface of the first lens is formed as an aspherical surface, and an emitting surface of the second lens is formed as a curved surface or a flat surface.

15. The lamp of claim 1, further comprising:

a heat dissipation unit disposed on a rear surface of the light source unit; and a support member to which the heat dissipation unit, the light source unit, the shield, and the lens unit are fixedly supported.

16. A lamp for a vehicle, comprising:

a light source unit for emitting light;

a lens unit for irradiating the light emitted from the light source unit to exterior of the lamp; and a shield disposed between the light source unit and the lens unit, wherein the light source unit comprises:

a first light source module including one or more first light sources and at least one first optical member arranged corresponding to the first light sources to emit light from the first light sources to the lens unit; and a second light source module disposed above the first light source module, the second light source module including at least one second light source and at least one second optical member arranged corresponding to the second light source to emit light from the second light source to the lens unit, wherein the first optical member comprises:

a first emitting surface, from which the light of the first light sources is emitted, formed on a front surface of the first optical member; and a plurality of first incident surfaces, on which the light of the first light sources is incident, formed on a rear surface of the first optical member, wherein the first emitting surface corresponds to the plurality of first incident surfaces, wherein at least one first light source is arranged for each of the plurality of first incident surfaces, and wherein the first emitting surface is formed overall convex to cause the light emitted from the first light sources to be collimated, the first emitting surface comprising:

a planar middle portion;

a first inclined peripheral portion that is inclined from the planar middle portion toward the rear surface; and a second inclined peripheral portion that is inclined from the planar middle portion toward the rear surface.

* * * * *